US008381656B1

(12) United States Patent
Woo et al.

(10) Patent No.: US 8,381,656 B1
(45) Date of Patent: Feb. 26, 2013

(54) MECHANICAL CARTRIDGE AND GRENADE VENTING

(75) Inventors: Timothy Woo, Flushing, NY (US); Leon Moy, Montclair, NJ (US); Bishara Elmasri, Landing, NJ (US); Christina Morales, Mine Hill, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/228,735

(22) Filed: Sep. 9, 2011

(51) Int. Cl.
*F41A 9/00* (2006.01)

(52) U.S. Cl. ..... 102/481

(58) Field of Classification Search ..... 102/481, 102/377, 381, 351, 293, 482
See application file for complete search history.

(56) References Cited

U.S. PATENT DOCUMENTS

| | | | | |
|---|---|---|---|---|
| 5,035,181 | A * | 7/1991 | Jacks et al. | 102/481 |
| 5,155,298 | A * | 10/1992 | Koontz | 102/481 |
| 5,394,803 | A * | 3/1995 | Mort | 102/377 |
| 6,523,477 | B1 * | 2/2003 | Brooks et al. | 102/481 |
| 6,752,085 | B2 * | 6/2004 | Roach | 102/481 |
| 7,150,231 | B2 * | 12/2006 | Olofsson | 102/481 |
| 7,331,292 | B1 * | 2/2008 | Kim et al. | 102/481 |
| 7,472,653 | B1 * | 1/2009 | Hays et al. | 102/481 |
| 7,549,375 | B2 * | 6/2009 | Cook et al. | 102/377 |
| 2003/0033954 | A1 * | 2/2003 | Brooks et al. | 102/481 |
| 2006/0254451 | A1 * | 11/2006 | Olofsson | 102/481 |
| 2010/0024675 | A1 * | 2/2010 | Cotet et al. | 102/481 |

* cited by examiner

*Primary Examiner* — Michael Carone
*Assistant Examiner* — Reginald Tillman, Jr.
(74) *Attorney, Agent, or Firm* — Michael C. Sachs

(57) ABSTRACT

To hinder activation caused by unplanned stimuli, a munition may include first and second discrete, separable parts. The first and second parts may include interlocking components to prevent relative axial translation of the first and second parts. The first and second parts may be torsionally biased in opposite directions. A binder with a low melting temperature may fix the first and second parts together to prevent the torsional bias from rotating the first and second parts in the opposite directions. When the binder melts, the torsional bias may cause the first part to rotate with respect to the second part. Relative rotation of the first and second parts may allow relative axial translation of the first and second parts.

37 Claims, 7 Drawing Sheets

Fig. 5C
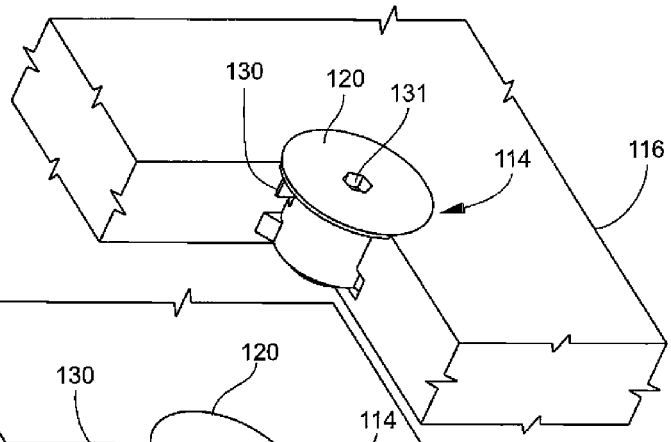
Fig. 5B
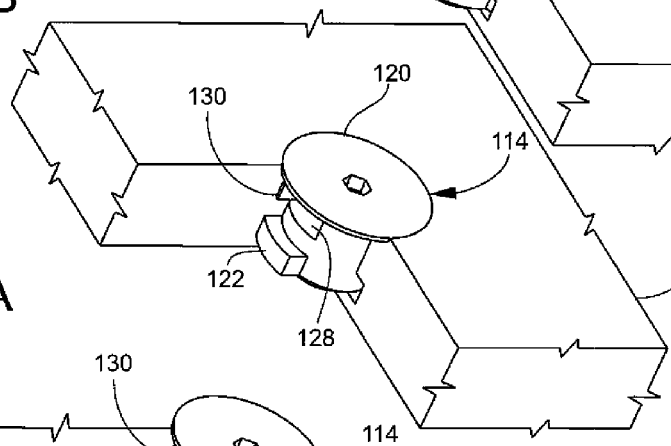
Fig. 5A
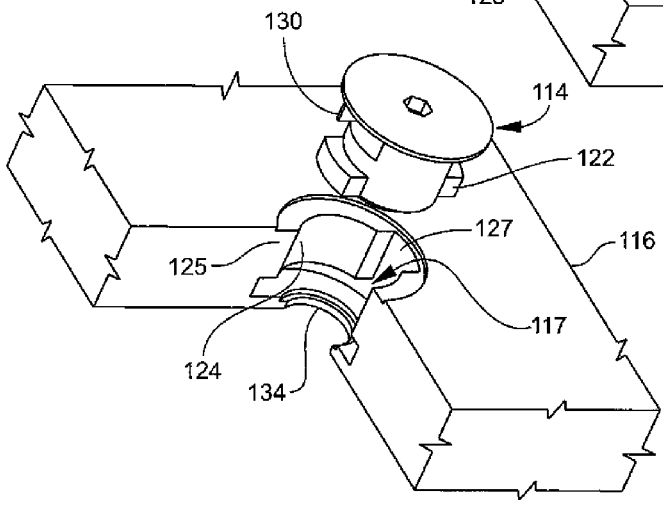
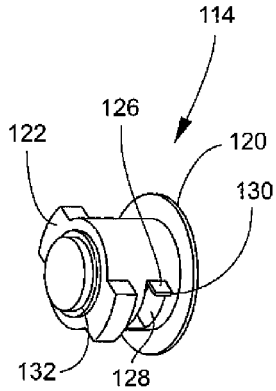
Fig. 4

MECHANICAL CARTRIDGE AND GRENADE VENTING

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to methods for safeguarding munitions that may be exposed to unplanned stimuli.

United States law may require that munitions meet certain safety standards, known as insensitive munition (IM) standards, to protect against unplanned stimuli. Two tests may be used to simulate munitions exposed to a fire, a slow cook off test (SCO) and a fast cook off test (FCO). In SCO, a munition in packaged configuration may be heated at a rate of 6° F./hour until the munition reacts. In FCO, a munition may be engulfed in a flame of at least 800° C. until the munition reacts. It may be desirable for the reaction to be limited to no more than burning (Type 5 reaction). A detonation (Type 1 reaction) may not be acceptable.

Munitions may demonstrate a Type 1 reaction when exposed to either the SCO or FCO tests. It has been found that when propellant is heated, gases may be given off and, if pressure is allowed to accumulate in a cartridge, the munition may detonate. Venting the gases may delay the point in time at which the detonation occurs. If the venting of gases is adequate, the propellant may burn vigorously without detonating.

Previous attempts at venting munitions have involved melt-away round plugs or threaded plugs. Some ionomer plastic plugs may not fully melt, thereby obstructing the vent. Some eutectic metal plugs may have a low tensile and shear strength, thereby causing the plug to fail under test firing. Some cartridges, for example, 25 mm cartridges, have been most difficult to render IM compliant. The difficulty may be due to the high propellant pressure generated and/or the small cartridge diameter.

Other munitions, such as grenades, for example, also generate gases when heated. A grenade, such as the M67 grenade, may contain a primary energetic material such as Composition B. If pressure is allowed to accumulate in the grenade body, the Composition B may detonate. If venting is adequate, the Composition B may burn vigorously without detonating. Past attempts at IM compliance included removing the fuse from the grenade to create a vent, or threading the circumference of the grenade body so that the grenade may split in half when the internal pressure rises. Neither solution has proven satisfactory.

A need exists for apparatus and methods for rendering munitions compliant with IM standards.

SUMMARY OF THE INVENTION

It is an object of the invention to provide apparatus and methods for rendering munitions compliant with IM standards.

One aspect of the invention is a munition having first and second discrete, separable parts. The first and second parts may include interlocking components that prevent relative axial translation of the first and second parts. A spring may torsionally bias the first and second parts in opposite directions. Energetic material may be disposed in the munition. A binder may fix the first and second parts together to prevent the spring from rotating the first and second parts in the opposite directions. The binder may have a melting temperature lower than melting temperatures of the first and second parts and lower than an ignition temperature of the energetic material. When the binder melts, the spring may rotate the first part with respect to the second part to allow relative axial translation of the first and second parts.

In one embodiment, the first part may be a cartridge case and the second part may be a plug that includes a primer pocket. The plug may be disposed in an end of the cartridge case.

In a second embodiment, there may be a plurality of second discrete, separable parts having interlocking components to prevent relative axial translation of the first part and the plurality of second parts. A plurality of springs may torsionally bias the first part and the plurality of second parts in opposite directions. A plurality of binders may fix the first part and the plurality of second parts together to prevent the springs from rotating the first part and the plurality of second parts in the opposite directions. When the binders melt, the springs may rotate the first part with respect to the plurality of second parts to allow relative axial translation of the first part and the plurality of second parts.

In a third embodiment, the first and second parts may be first and second mating portions of a grenade body and the interlocking components may include projections on the first mating portion and projections on the second mating portion.

Another aspect of the invention is a method that may include providing a munition having first and second discrete, separable parts. The first and second parts may include interlocking components to prevent relative axial translation of the first and second parts. The first and second parts may be torsionally biased in opposite directions. The method may include binding the first and second parts together with a binding material to prevent relative rotation of the first and second parts in the opposite directions. After the binding material is melted, the first part may be rotated with respect to the second part.

After rotating the first part with respect to the second part, the method may include axially translating the first part with respect to the second part.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 4 is a perspective view of a plug shown in FIG. 3.

FIGS. 5A-C are partial, perspective, cutaway views of the cartridge of FIG. 3, illustrating how the plugs may be locked in the cartridge case.

DETAILED DESCRIPTION OF THE PREFERRED EMBODIMENTS

A munition may include first and second discrete, separable parts. The first and second parts may include interlocking components. The interlocking components may prevent relative axial translation of the first and second parts. The first and second parts may be torsionally biased in opposite directions. The torsional bias may be supplied by, for example, a spring.

A binder may fix the first and second parts together to prevent the torsional bias from rotating the first and second parts in the opposite directions. The binder may have a melting temperature lower than melting temperatures of the first and second parts. When the binder melts, the torsional bias may cause the first part to rotate with respect to the second part. Relative rotation of the first and second parts may allow relative axial translation of the first and second parts.

Figure 1:
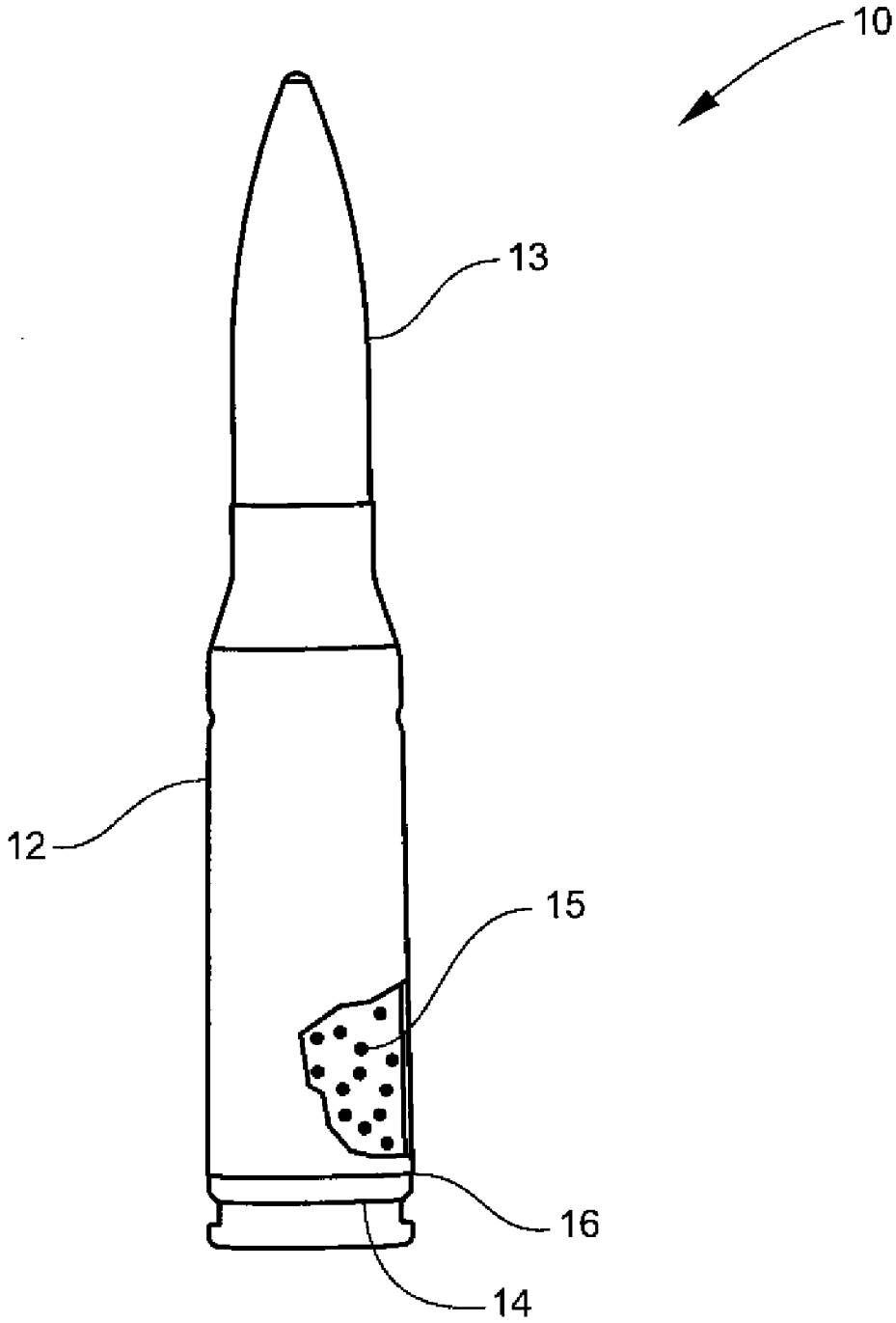
FIG. 1 is a side view of an embodiment of a gun cartridge that may be less sensitive to unplanned stimuli than known gun cartridges.

FIG. 1 is a side view of an embodiment of a munition, for example, a gun cartridge 10. Cartridge 10 may be less sensitive to unplanned stimuli than known gun cartridges. Cartridge 10 may include a cartridge case 12, a bullet or payload 13, and a plug 14. Plug 14 may be disposed in an end 16 of cartridge case 12. An energetic material such as, for example, propellant 15 may be disposed in cartridge case 12.

Figure 2:
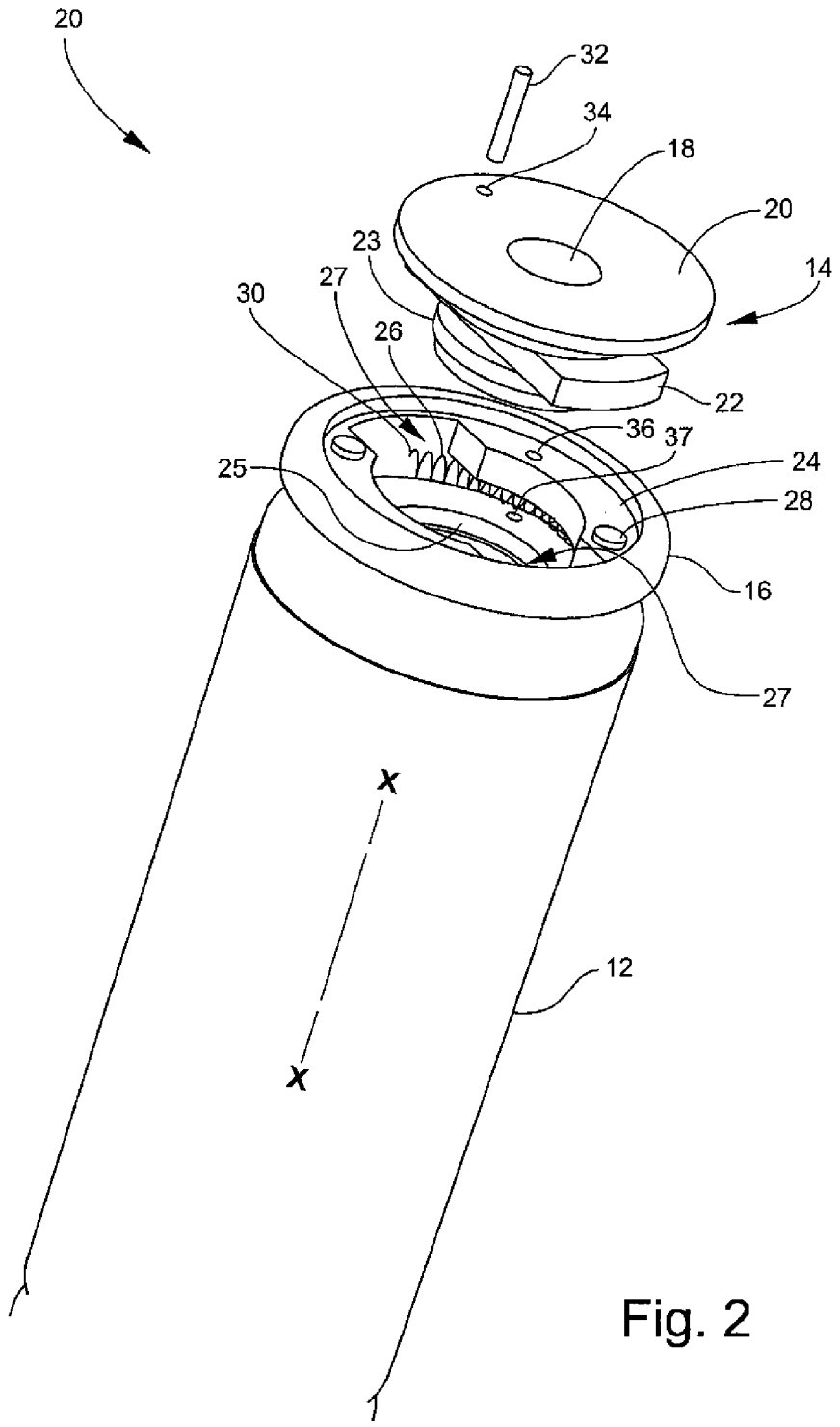
FIG. 2 is an enlarged, exploded, partial perspective view of the cartridge of FIG. 1.

FIG. 2 is an enlarged, exploded, partial perspective view of cartridge 10 of FIG. 1. Plug 14 may include a primer pocket 18 for receiving a primer (not shown). Plug 14 may include a disc portion 20. Disc portion 20 may at least partially close end 16 of cartridge case 12. Plug 14 may include a locking portion 22. Locking portion 22 may be axially spaced apart (for example, along central longitudinal axis X-X of cartridge 10) from disc portion 20. Locking portion 22 may bear on a bearing portion 24 of cartridge case 12.

Plug 14 may include a plug binding surface 23 that may be axially spaced apart from locking portions 22. Cartridge case 12 may include a cartridge binding surface 25 that may be axially spaced apart from bearing portions 24. Plug binding surface 23 and cartridge binding surface 25 may be mating surfaces.

In the embodiment of FIG. 2, two locking portions 22 and two bearing portions 24 are shown, although other numbers of locking portions 22 and bearing portions 24 may be used. Locking portions 22 may be in the form of opposing wings. Bearing portions 24 may be in the form of opposing partial annuli. A spring 26 may be disposed beneath each bearing portion 24. One end of each spring 26 may be fixed to a respective spring stop 28.

Before plug 14 is inserted in end 16 of case 12, plug binding surface 23 and cartridge binding surface 25 may be pre-coated with a binder, for example, a solder comprising a eutectic metal. Spring 26 may be compressed and held in place by, for example, inserting a pin 32 in openings 36 and 37. Pin 32 may be, for example, a paper clip. Plug 14 and cartridge case 12 may be heated to melt the solder that was pre-coated on surfaces 23 and 25. Plug 14 may be inserted in end 16 of cartridge case 12 so that locking portions 22 pass through gaps 27 between bearing portions 24. Plug 14 may be rotated so that free end 30 of spring 26 (now compressed) may bear against locking portion 22 of plug 14 and locking portions 22 may lie beneath bearing portions 24. As oriented in FIG. 2, the rotation may be in a clockwise direction. After rotating plug 14 in end 16 of case 12, locking portions 22 and bearing portions 24 may prevent axial translation of plug 14 with respect to cartridge case 12.

Pin 32 may be removed from openings 36 and 37 and then inserted in coaxial openings 34 and 36. After plug 14 and case 12 cool and the solder on surfaces 23 and 25 solidifies, pin 32 may be removed from openings 34 and 36. The solidified solder on surfaces 23 and 25 may prevent spring 26 from rotating plug 14 relative to cartridge case 12.

In another embodiment, pin 32 may be a eutectic wire. When plug 14 and case 12 are heated to melt the solder on surfaces 23 and 25, the eutectic wire (pin 32) in openings 36 and 37 may also melt. In that case, a second pin 32 (for example, a paper clip) may be inserted in coaxial openings 34 and 36 while the solder solidifies. Of course, other methods may also be used to hold plug 14 in place against the force of spring 26 until the solder on surfaces 23 and 25 solidifies.

The melting temperature of the solder on surfaces 23 and 25 may be less than the melting temperatures of plug 14 and cartridge case 12. The melting temperature of the solder may be less than a temperature at which propellant 15 in cartridge 10 may ignite. The melting temperature of the solder may be greater than the temperature to which the solder rises during a normal firing of cartridge 10 in a gun. Thus, when cartridge 10 is fired from a gun in a normal manner, plug 14 will remain in place in end 16 of cartridge case 12 because locking portions 22 may bear on bearing portions 24 and prevent relative axial translation of plug 14 and cartridge case 12.

If cartridge 10 is exposed to a stimulus, propellant 15 in cartridge 10 may begin an exothermic reaction. The stimulus or the exothermic reaction may raise the temperature of the solder on surfaces 23 and 25 to or beyond the melting temperature of the solder. Then, the solder may fail. Failure of the solder on surfaces 23 and 25 may allow spring or springs 26 to rotate plug 14 in a counterclockwise direction, as oriented in FIG. 2. Locking portions 22 of plug 14 may become aligned with gaps 27 between bearing portions 24, thereby allowing relative axial translation between plug 14 and cartridge case 12. Translation between plug 14 and case 12 may create a vent for propellant gases produced in cartridge case 12 and, therefore, may prevent a detonation of propellant 15 in cartridge case 12.

Figure 3:
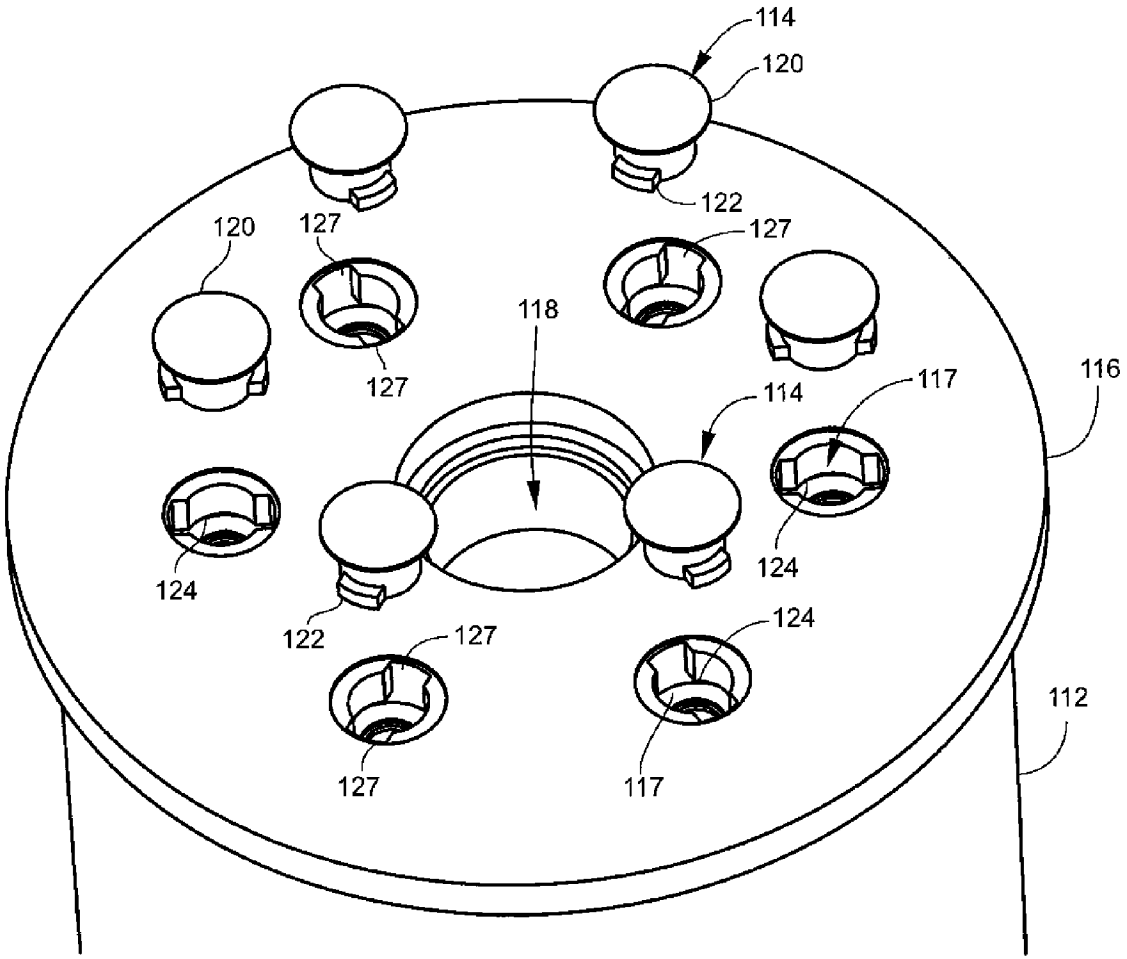
FIG. 3 is an exploded, partial perspective view of another embodiment of a gun cartridge that may be less sensitive to unplanned stimuli than known gun cartridges.

It may be desirable to provide more than one plug in some embodiments, for example, in large caliber gun cartridges, such as 105 mm cartridges. FIG. 3 is an exploded, partial perspective view of another embodiment of a gun cartridge 100 that may be less sensitive to unplanned stimuli than known gun cartridges. Cartridge 100 may include a cartridge case 112 having an end 116. End 116 may include a primer pocket 118 and a plurality of plug openings 117. Plugs 114 may be disposed in respective plug openings 117. Six plugs 114 are shown in FIG. 3, but the number of plugs 114 may be more or less than six.

Plug 114 may include a disc portion 120. Disc portion 120 may close plug opening 117 in end 116 of cartridge case 112. Plug 114 may include a locking portion 122. Locking portion 122 may be axially spaced apart from disc portion 120. Locking portion 122 may bear on a bearing portion 124 of cartridge case 112. In the embodiment of FIG. 3, two locking portions 122 and two bearing portions 124 are shown on each plug 114, although other numbers of locking portions 122 and bearing portions 124 may be used. Locking portions 122 may be in the form of, for example, opposing wings. Bearing portions 124 may be in the form of, for example, opposing partial annuli.

A spring 126 (FIG. 4) may be disposed in each plug 114 between disc portion 120 and locking portions 122. Spring 126 may be, for example, a coil spring or a leaf spring. One end (not shown) of spring 126 may be fixed to an interior of plug 114. A free end 130 of spring 126 may protrude from plug 114. Free end 130 of spring 126 may be movable in a slot 128 formed in plug 114. Plug 114 may also include a binding surface 132 on which a binder, such as a eutectic metal solder, may be pre-coated.

FIGS. 5A-C are partial, perspective, cutaway views of cartridge end 116, illustrating how plugs 114 may be locked in plug openings 117. Each opening 117 may include a cartridge binding surface 134 on which a binder, such as a eutectic metal solder, may be pre-coated. Prior to installing plugs 114 in openings 117, plugs 114 and end 116 of case 112 may be heated to soften the solder that is pre-coated on surfaces 132 (FIG. 4) and 134.

In FIG. 5A, plug 114 is in a position above plug opening 117. Plug 114 may be inserted in opening 117 so that locking portions 122 pass through gaps 127 between bearing portions 124 and disc portion 120 is substantially even with end 116 of case 112.

FIG. 5B shows plug 114 inserted in opening 117 with free end 130 of spring 126 adjacent an end 125 of bearing portion 124. As plug 114 is rotated in opening 117 in the direction of the arrow in FIG. 5B, free end 130 of spring 126 may bear against end 125, creating a spring force in spring 126. A wrench fitting 131 may be included in disc portion 120 for ease of rotating plug 114 and for holding plug 114 in position until the solder on surfaces 132 and 134 solidifies. A fully rotated position of plug 114 is shown in FIG. 5C. In the position of FIG. 5C, locking portions 122 may lie beneath bearing portions 124. Thus, locking portions 122 and bearing portions 124 may prevent axial translation of plug 114 with respect to cartridge case 112.

The melting temperature of the solder on surfaces 132 and 134 may be less than the melting temperatures of plug 114 and cartridge case 112. The melting temperature of the solder on surfaces 132 and 134 may be less than a temperature at which propellant (such as propellant 15 in cartridge 10) may ignite. The melting temperature of the solder on surfaces 132 and 134 may be greater than the temperature to which the solder rises during a normal firing of cartridge 110 in a gun. Thus, when cartridge 110 is fired from a gun in a normal manner, plugs 114 may remain in place in end 116 of cartridge case 112 because locking portions 122 may bear on bearing portions 124 and prevent relative axial translation of plugs 114 and cartridge case 112.

If cartridge 110 is exposed to a stimulus, propellant in cartridge 110 may begin an exothermic reaction. The stimulus of exothermic reaction may raise the temperature of the solder to or beyond its melting temperature. Then, the solder on surfaces 132 and 134 may fail. Failure of the solder may allow springs 126 to rotate plugs 114 in a direction opposite the arrow in FIG. 5B. Locking portions 122 of plugs 114 may become aligned with gaps 127 between bearing portions 124, thereby allowing relative axial translation between plugs 114 and cartridge case 112. Translation between plugs 114 and case 112 may create vents for propellant gases produced in cartridge case 112 and, therefore, may prevent a detonation of propellant in cartridge case 112.

Figure 6:
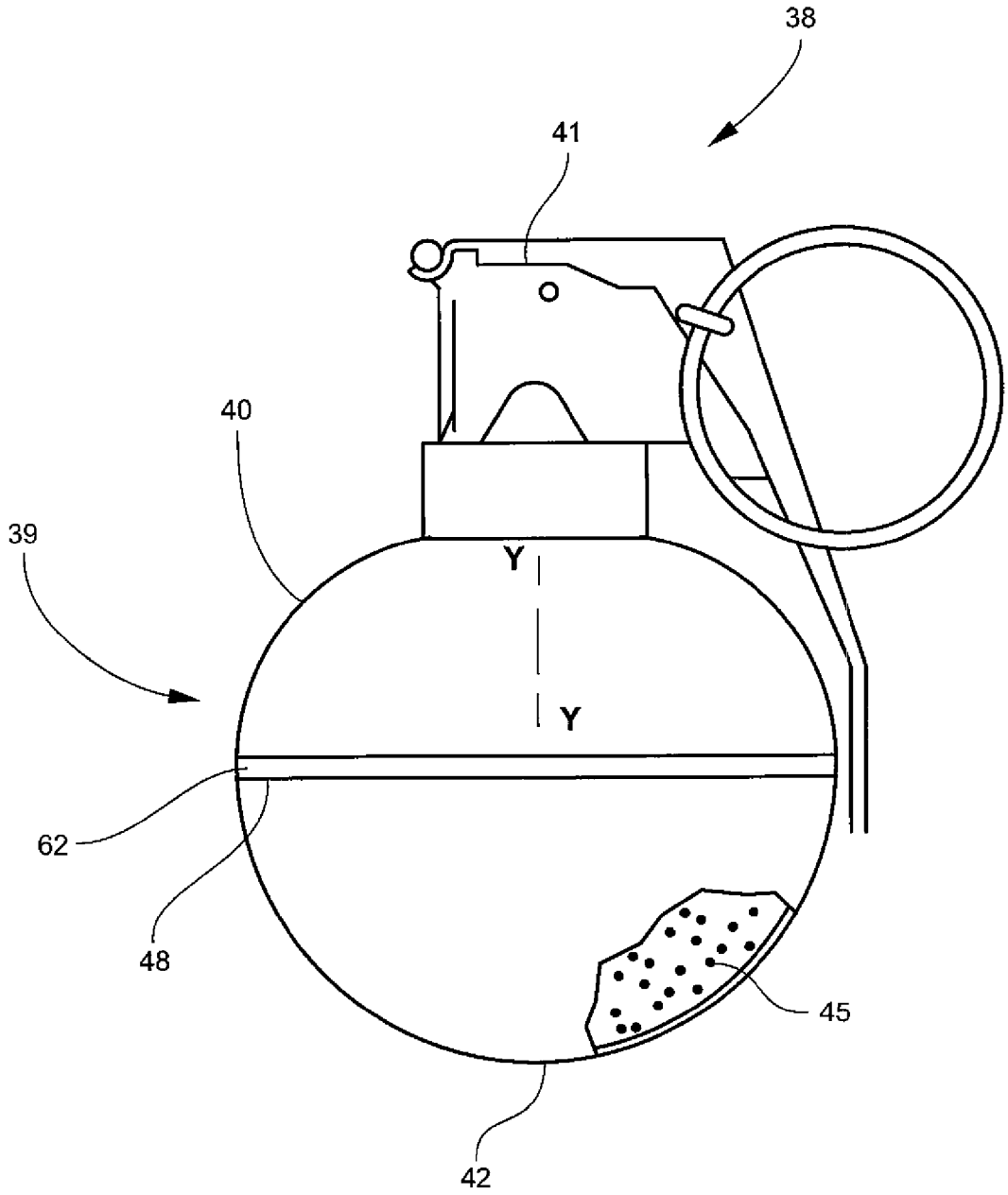
FIG. 6 is a side view of an embodiment of a grenade that may be less sensitive to unplanned stimuli than known grenades.

FIG. 6 is a side view of a munition, for example, a grenade 38. Grenade 38 may be less sensitive to unplanned stimuli than known grenades. Grenade 38 may include a grenade body 39 and a fuze 41. Grenade body 39 may include first and second mating portions 40, 42. Mating portions 40, 42 may be connected at a seam 48. Mating portions 40, 42 may each comprise, for example, about one half of grenade body 39. Energetic material 45 may be disposed in grenade body 39.

Figure 7:
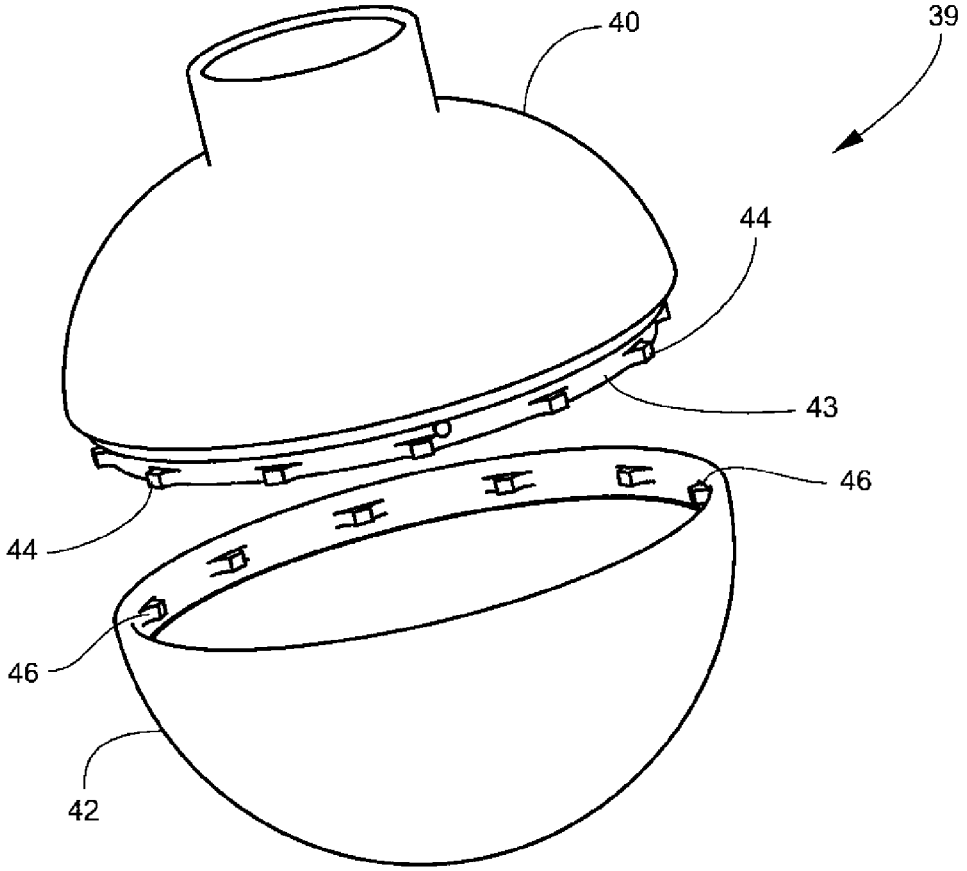
FIG. 7 is an exploded perspective view of the grenade body of FIG. 6.

FIG. 7 is an exploded view of body 39 of grenade 38. Mating portion 40 may include a reduced diameter portion 43 near seam 48. Reduced diameter portion 43 may include a plurality of projections 44. Mating portion 42 may include a plurality of projections 46 on an interior surface thereof. Reduced diameter portion 43 may be inserted in mating portion 42 when projections 44, 46 are unaligned. Then, mating portions 40, 42 may be rotated relative to each other so that projections 44 are beneath and aligned with projections 46. Thus, relative axial translation (for example, along a central longitudinal axis Y-Y of grenade 38) of mating portions 40, 42 may be prevented by the bearing force between projections 44, 46.

Figure 8C:
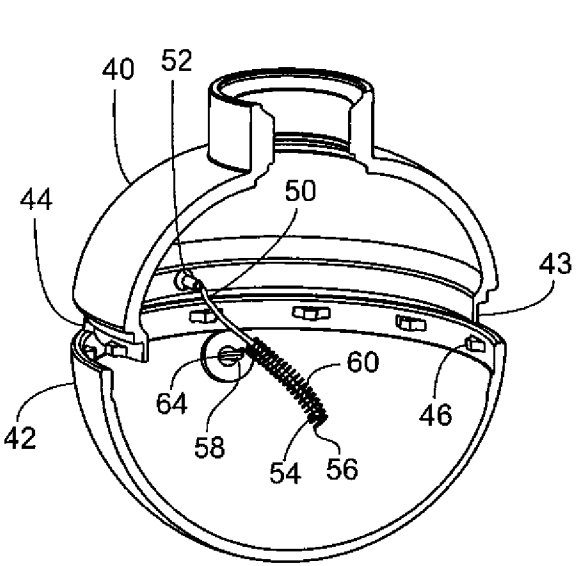
FIGS. 8A-C are partial perspective views of the interior of the grenade body of FIG. 7, illustrating one method of unlocking the mating portions of the grenade body.
Figure 8B:
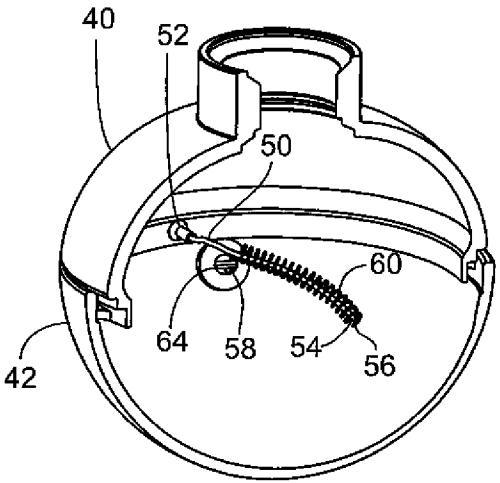
Figure 8A:
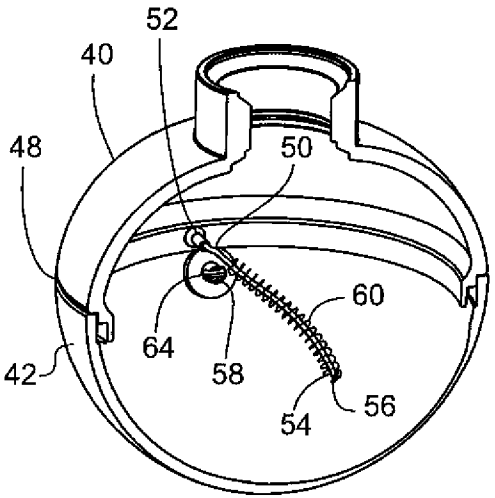

FIGS. 8A-C are partial perspective views of the interior of grenade body 39, illustrating one method of locking and unlocking mating portions 40, 42. FIG. 8A shows mating portions 40, 42 in a locked position. FIG. 8B shows mating portions 40, 42 in an unlocked position. FIG. 8C shows mating portions 40, 42 in an unlocked position and axially translated with respect to each other.

A tension arm 50 may have one end 52 fixed to one of the mating portions, for example, mating portion 40. Another end of tension arm 50 may be a free end 54. A spring 60 may have one end 56 fixed to free end 54 of tension arm 50. Another end 58 of spring 60 may be fixed to the other of the mating portions, for example, mating portion 42. End 58 may be fixed to, for example, a hook 64 on the interior of mating portion 42. Tension arm 50 and spring 60 may provide a torsional bias to mating portions 40, 42. As oriented in FIGS. 8A-C, the torsional bias may cause mating portion 40 to move to the left with respect to mating portion 42.

When the mating portions 40, 42 are in the locked position of FIG. 8A, a binder 62 (FIG. 6) may be applied to the exterior of mating portions 40, 42 at seam 48. Binder 62 may provide an air-tight seal to seam 48. Seam 48 may be, for example, a circumferential seam. Binder 62 may be, for example, a eutectic metal applied at seam 48 between mating portions 40, 42. The eutectic metal may be applied as a solder, for example. Binder 62 may hold mating portions 40, 42 in the locked position of FIG. 8A, notwithstanding the torsional bias applied by spring 60 and tension arm 50.

A melting temperature of binder 62 may be less than melting temperatures of mating portions 40, 42. The melting temperature of binder 62 may be less than the ignition temperature of energetic material 45 contained in grenade 38. When grenade 38 is exposed to heat, energetic material 45 in grenade 38 may melt first. Binder 62 may then melt. When binder 62 melts, spring 60 may rotate mating portions 40, 42 relative to each other, as shown in FIG. 8B. Spring 60 may rotate mating portions 40, 42 so that projections 46 on mating portion 42 are no longer aligned with projections 44 on mating portion 40. Then, the force of spring 60 and/or the expanding energetic material 45 in grenade 38 may axially translate mating portions 40, 42 relative to each other, as shown in FIG. 8C. Relative axial translation of mating portions 40, 42 may allow energetic material 45 in the interior of grenade 38 to pour out between separated mating portions 40, 42. Being thus unconfined, energetic material 45 may burn without detonating.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A munition, comprising:

first and second discrete, separable parts, the first and second parts including interlocking components to prevent relative axial translation of the first and second parts;

a spring that torsionally biases the first and second parts in opposite directions;

energetic material disposed in the munition; and a binder that fixes the first and second parts together to prevent the spring from rotating the first and second parts in the opposite directions, the binder having a melting temperature lower than melting temperatures of the first and second parts and lower than an ignition temperature of the energetic material;

wherein, when the binder melts, the spring rotates the first part with respect to the second part to allow relative axial translation of the first and second parts.

2. The munition of claim 1, wherein one end of the spring is fixed to one of the first and second parts.

3. The munition of claim 2, wherein the binder comprises a eutectic metal solder.

4. The munition of claim 2, wherein the first part is a cartridge case and the second part is a plug that includes a primer pocket, the plug being disposed in an end of the cartridge case.

5. The munition of claim 4, wherein the plug includes a disc portion for at least partially closing the end of the cartridge case and a locking portion axially spaced apart from the disc portion, the locking portion bearing on a bearing portion of the cartridge case.

6. The munition of claim 5, wherein the cartridge case includes a spring stop, the one end of the spring being fixed to the spring stop.

7. The munition of claim 6, wherein a free end of the spring bears against the locking portion of the plug.

8. The munition of claim 7, wherein the binder fixes the plug to the cartridge case.

9. The munition of claim 8, wherein the bearing portion of the cartridge case comprises a portion of an annulus.

10. The munition of claim 9, wherein the binder is precoated on a binding surface on the plug and on a binding surface on the cartridge case.

11. The munition of claim 1, further comprising a plurality of second discrete, separable parts having interlocking components to prevent relative axial translation of the first part and the plurality of second parts; a plurality of springs that torsionally bias the first part and the plurality of second parts in opposite directions; a plurality of binders that fix the first part and the plurality of second parts together to prevent the springs from rotating the first part and the plurality of second parts in the opposite directions, the binders having melting temperatures lower than melting temperatures of the first part and the plurality of second parts and lower than an ignition temperature of the energetic material; wherein, when the binders melt, the springs rotate the first part with respect to the plurality of second parts to allow relative axial translation of the first part and the plurality of second parts.

12. The munition of claim 11, wherein the first part is a cartridge case and the plurality of second parts are plugs that are disposed in respective plug openings in an end of the cartridge case.

13. The munition of claim 12, wherein each plug includes a disc portion for closing the respective plug opening and a locking portion axially spaced apart from the disc portion, the locking portion bearing on a bearing portion of the cartridge case.

14. The munition of claim 12, wherein the binders comprise eutectic metal solder.

15. The munition of claim 2, wherein the first and second parts are first and second mating portions of a grenade body and the interlocking components include projections on the first mating portion and projections on the second mating portion.

16. The munition of claim 15, wherein alignment of the projections on the first and second mating portions prevents relative axial translation of the first and second mating portions.

17. The munition of claim 16, wherein the first and second mating portions each comprise about one half of the grenade body.

18. The munition of claim 16, wherein the binder comprises a eutectic metal applied at a seam between the first and second mating portions.

19. The munition of claim 16, further comprising a tension arm having one end fixed to one of the mating portions and a free end, the spring having one end fixed to the free end of the tension arm and another end fixed to the other of the mating portions.

20. The munition of claim 19, wherein the other end of the spring is fixed to a hook on the other of the mating portions.

21. The munition of claim 17, wherein the first mating portion includes a reduced diameter portion and the projections of the first mating portion are located on the reduced diameter portion.

22. The munition of claim 21, wherein the projections on the second mating portion are located on an interior of the second mating portion.

23. A munition, comprising:

a cartridge case and a plug that includes a primer pocket;

the plug being disposed in an end of the cartridge case, the plug including a disc portion for at least partially closing the end of the cartridge case and a locking portion axially spaced apart from the disc portion, the locking portion bearing on a bearing portion of the cartridge case to prevent relative axial translation of the cartridge case and the plug;

propellant disposed in the cartridge case;

a spring that torsionally biases the cartridge case and the plug in opposite directions; and eutectic material that fixes the cartridge case and the plug together to prevent the spring from rotating the cartridge case and the plug in the opposite directions, the eutectic material having a melting temperature lower than melting temperatures of the cartridge case and the plug and lower than an ignition temperature of the propellant;

wherein, when the eutectic material melts, the spring rotates the cartridge case with respect to the plug to allow relative axial translation of the cartridge case and the plug.

24. A munition, comprising:

a cartridge case and a plurality of plugs;

the plugs being disposed in a plurality of respective plug openings in an end of the cartridge case, each plug including a disc portion for closing the respective plug opening and a locking portion axially spaced apart from the disc portion, the locking portion bearing on a bearing portion of the cartridge case to prevent relative axial translation of the cartridge case and the plug;

propellant disposed in the cartridge case;

a plurality of springs that torsionally bias the cartridge case and the plugs in opposite directions; and eutectic material that fixes the cartridge case and the plugs together to prevent the springs from rotating the cartridge case and the plugs in the opposite directions, the eutectic material having a melting temperature lower than melting temperatures of the cartridge case and the plugs and lower than an ignition temperature of the propellant;

wherein, when the eutectic material melts, the springs rotate the cartridge case with respect to the plugs to allow relative axial translation of the cartridge case and the plugs.

25. A munition, comprising:

first and second mating portions of a grenade body, the first and second mating portions including aligned projections to prevent relative axial translation of the first and second mating portions;

energetic material disposed in the grenade body;

a spring that torsionally biases the first and second mating portions in opposite directions;

eutectic material disposed at a seam between the first and second mating portions, the eutectic material fixing the first and second mating portions together to prevent the spring from rotating the first and second mating portions in the opposite directions, the eutectic material having a melting temperature lower than melting temperatures of the first and second mating portions and lower than an ignition temperature of the energetic material; and a tension arm having one end fixed to one of the mating portions and a free end, the spring having one end fixed to the free end of the tension arm and another end fixed to the other of the mating portions;

wherein, when the eutectic material melts, the spring rotates the first mating portion with respect to the second mating portion to allow relative axial translation of the first and second mating portions.

26. A method, comprising:

providing a munition having first and second discrete, separable parts, the first and second parts including interlocking components to prevent relative axial translation of the first and second parts;

torsionally biasing the first and second parts in opposite directions; and binding the first and second parts together with a binding material to prevent relative rotation of the first and second parts in the opposite directions, the binding material having a melting temperature lower than melting temperatures of the first and second parts;

melting the binding material; and rotating the first part with respect to the second part.

27. The method of claim 26, further comprising, after rotating the first part with respect to the second part, axially translating the first part with respect to the second part.

28. The method of claim 27, wherein the binding material comprises a eutectic metal.

29. The method of claim 27, wherein the first part is a cartridge case and the second part is a plug that includes a primer pocket, the plug being disposed in an end of the cartridge case.

30. The method of claim 27, wherein the first and second parts are first and second mating portions of a grenade body and the interlocking components include projections on the first mating portion and projections on the second mating portion.

31. The method of claim 29, wherein the plug includes a disc portion for at least partially closing the end of the cartridge case and a locking portion axially spaced apart from the disc portion, the locking portion bearing on a bearing portion of the cartridge case to prevent relative axial translation of the plug and the cartridge case.

32. The method of claim 31, wherein binding includes fixing the plug to the cartridge case with the binding material.

33. The method of claim 32, wherein the bearing portion of the cartridge case comprises a portion of an annulus.

34. The method of claim 30, wherein alignment of the projections on the first and second mating portions prevents relative axial translation of the first and second mating portions.

35. The method of claim 34, wherein binding includes applying a eutectic metal to a seam between the first and second mating portions.

36. The method of claim 30, wherein the munition includes a tension arm having one end fixed to one of the mating portions and a free end, and a spring having one end fixed to the free end of the tension arm and another end fixed to the other of the mating portions.

37. The method of claim 26, further comprising providing energetic material in the munition, the binding material having a melting temperature lower than an ignition temperature of the energetic material.

* * * * *